US011473775B2

(12) United States Patent
Ferretti et al.

(10) Patent No.: US 11,473,775 B2
(45) Date of Patent: Oct. 18, 2022

(54) COOKING APPLIANCE HAVING A HOB

(71) Applicant: WHIRLPOOL CORPORATION, Benton Harbor, MI (US)

(72) Inventors: Siro Ferretti, Fabriano (IT); Tiziano Lacche, Matelica (IT); Giuseppino Perticara, Corridonia (IT)

(73) Assignee: Whirlpool Corporation, Benton Harbor, MI (US)

( * ) Notice: Subject to any disclaimer, the term of this patent is extended or adjusted under 35 U.S.C. 154(b) by 289 days.

(21) Appl. No.: 16/536,109

(22) Filed: Aug. 8, 2019

(65) Prior Publication Data

US 2021/0041101 A1 Feb. 11, 2021

(51) Int. Cl.
*F23D 14/06* (2006.01)
*F24C 3/08* (2006.01)

(52) U.S. Cl.
CPC ..... *F23D 14/06* (2013.01); *F24C 3/082* (2013.01); *F23D 2213/00* (2013.01)

(58) Field of Classification Search
CPC ..... F23D 14/00; F23D 14/02; F23D 14/04; F23D 14/06; F23D 14/065; F23D 14/20; F23D 2213/00; F23D 14/64; F24C 3/08; F24C 3/082
USPC ..... 126/39 E, 39 R
See application file for complete search history.

(56) References Cited

U.S. PATENT DOCUMENTS 2,348,011 A * 5/1944 Koppel ..... F23D 14/04 239/552
2,470,880 A * 5/1949 Zimbelman ..... F23D 14/105 239/556
2,701,610 A 2/1955 Carlson
2,930,433 A 3/1960 Brodbeck et al.
6,746,236 B2 * 6/2004 Kuriyama ..... F23D 14/04 431/278
9,028,246 B2 * 5/2015 Brandt ..... F23D 14/02 431/178
9,127,838 B2 * 9/2015 Paesani ..... F23D 14/065
9,612,018 B2 4/2017 Bettinzoli
10,145,563 B2 12/2018 Dora
(Continued)

FOREIGN PATENT DOCUMENTS

EP 3128236 A1 2/2017
EP 3286498 B1 9/2018
(Continued)

OTHER PUBLICATIONS

Benatar, Avraham, "Applied Plastics Engineering Handbook", William Andrew Applied Science Publishers, 2nd Edition, pp. 579-580 (Year: 2017).*

(Continued)

*Primary Examiner* — Alfred Basichas
(74) *Attorney, Agent, or Firm* — McGarry Bair PC

(57) ABSTRACT

A cooking appliance includes a cooking area. A hob can be located in the cooking area. The hob includes an injector holder base defining an air chamber and a burner interface chamber. An injector holder cover overlies the injector holder base. The injector holder base and the injector holder cover collectively define a venturi tube extending between the air chamber and the burner interface chamber. An injector is carried by at least one of the injector holder base or injector holder cover. A burner is supported on the injector holder cover.

20 Claims, 12 Drawing Sheets

(56) References Cited

U.S. PATENT DOCUMENTS

| | | | | |
|---|---|---|---|---|
| 10,451,273 | B2 * | 10/2019 | Rasi | F24C 3/085 |
| 2007/0278319 | A1 | 12/2007 | Jenkins et al. | |
| 2017/0268788 | A1 * | 9/2017 | Culatti | F23D 14/02 |
| 2017/0370576 | A1 | 12/2017 | Fang et al. | |
| 2018/0320903 | A1 * | 11/2018 | Cadima | F23D 14/84 |

FOREIGN PATENT DOCUMENTS

| | | | | |
|---|---|---|---|---|
| WO | WO-2010105748 | A2 * | 9/2010 | F23D 14/065 |
| WO | WO-2016170497 | A1 * | 10/2016 | F23D 14/06 |
| WO | WO-2020047917 | A1 * | 3/2020 | F23D 14/02 |
| WO | WO-2021006829 | A1 * | 1/2021 | F23C 7/008 |
| WO | WO-2021006830 | A1 * | 1/2021 | F24C 3/085 |
| WO | WO-2021006831 | A * | 1/2021 | F23D 14/065 |
| WO | WO-2021006832 | A1 * | 1/2021 | F23D 14/64 |

OTHER PUBLICATIONS

European Search Report for Counterpart EP20186819.7, dated Dec. 14, 2020.

* cited by examiner

COOKING APPLIANCE HAVING A HOB

BACKGROUND

Cooking appliances, such as cooktops, ranges, etc., have cooking areas with hobs or burners that emit heat to heat or cook edible items, and are often housed in a kitchen within a home or business. A cooking vessel of some type, like a skillet, pot, or pan, is placed on the burner where heat from the burner is transferred to the cooking vessel. Cooking appliances can provide cooking energy, for example, through the use of electricity or gas fuel. Traditional gas cooking appliances can include a gas heating element that is coupled to a hob or burner to heat items placed on the hob or burner by direct heat by providing a flame directly underneath the items placed on the hob or burner. Coupling a gas heating element to the hob or burner can be done by an injector. An injector holder can be provided to retain and carry the injector such that the gas is supplied to the hob or burner in a precise manner. The additional components required for providing a gas heating element and injector holder for the hob or burner add cost to the cooking appliance and take up valuable space within the cooking appliance.

BRIEF SUMMARY

According to one aspect of the present disclosure, a cooking appliance comprises a cooking area and a hob located in the cooking area, the hob comprising an injector holder base defining an air chamber, a burner interface chamber, and a first open channel fluidly coupling the air chamber and the burner interface chamber, an injector holder cover overlying the injector holder base and stamped to the injector holder base, the injector holder cover having a second open channel confronting the first open channel to collectively define a venturi tube extending between the air chamber and the burner interface chamber, an injector carried by at least one of the injector holder base or injector holder cover and fluidly coupled to the air chamber opposite the venturi tube, and a burner supported on the injector holder cover and fluidly coupled to the burner interface chamber.

DETAILED DESCRIPTION

Figure 1:
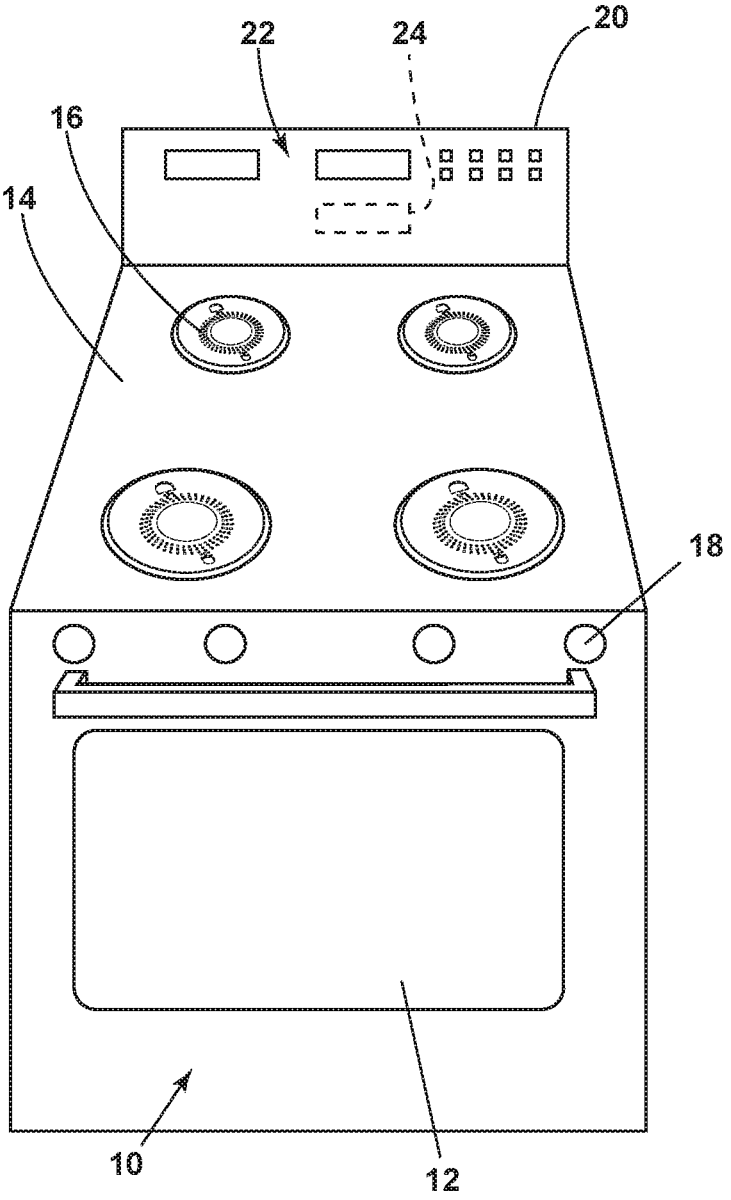
FIG. 1 is a perspective schematic view of a cooking appliance having a cooking area with multiple cooking hobs.

FIG. 1 illustrates an exemplary cooking appliance 10 or cooking surface for use in cooking, baking and/or broiling food items according to a cycle of operation, the cooking appliance 10 illustrated herein as an automatic household oven. The cooking appliance 10 can include an oven 12 and a cooking area, illustrated herein as a stovetop 14, also referred to as a cooktop or range. Alternatively, the cooking appliance 10 can only include the stovetop 14, and need not be a full oven 12 and stovetop 14 combination. The stovetop 14 can include a set of burners or heaters, illustrated herein as a set of hobs 16, which can define a heating zone for heating a cooking utensil, such as a pot or pan. A set, as used herein, can refer to any suitable number of hobs 16, including a single hob 16. The hobs 16 can be controlled with a set of knobs 18 provided on the cooking appliance 10. In one aspect, at least one hob 16 can be fueled by gas, though it will be understood that the other hobs 16 can be gas or electric, for example, while alternative heating methods are also contemplated, such as convection, conduction, or induction.

The cooking appliance 10 can further include a rear panel 20 with a user interface 22. The user interface 22 can be used by a user to control operation of the cooking appliance 10, such as by setting a temperature for the oven 12 or by setting a timer. In one alternative example, the user interface 22 can be used to control the hobs 16 in lieu of or in addition to the knobs 18. The cooking appliance 10 can be provided between cabinets or other appliances on either side of the cooking appliance 10, while it is also contemplated that the cooking appliance 10 can be stand-alone, or provided in any suitable position.

A controller 24 or cooking controller is provided in the cooking appliance 10 for operating the cooking appliance 10, and can be included in the rear panel 20 near the user interface 22, for example. More specifically, the controller 24 can operate the cooking appliance 10 via input from a user received at the user interface 22, such as for selecting a cycle of operation and controlling the operation of the cooking appliance 10 to implement the selected cycle of operation. It is also contemplated that software can partially or fully automate operation of the cooking appliance 10 without direct control from the user. The controller 24, as well as the cooking appliance 10, can further be wirelessly enabled including a wireless communication module 64 (FIG. 3), such as being WI-FI enabled, permitting communication with a local or external network 66 (FIG. 3), as well as other devices or systems communicable with the cooking appliance 10 via the controller 24.

Figure 2:
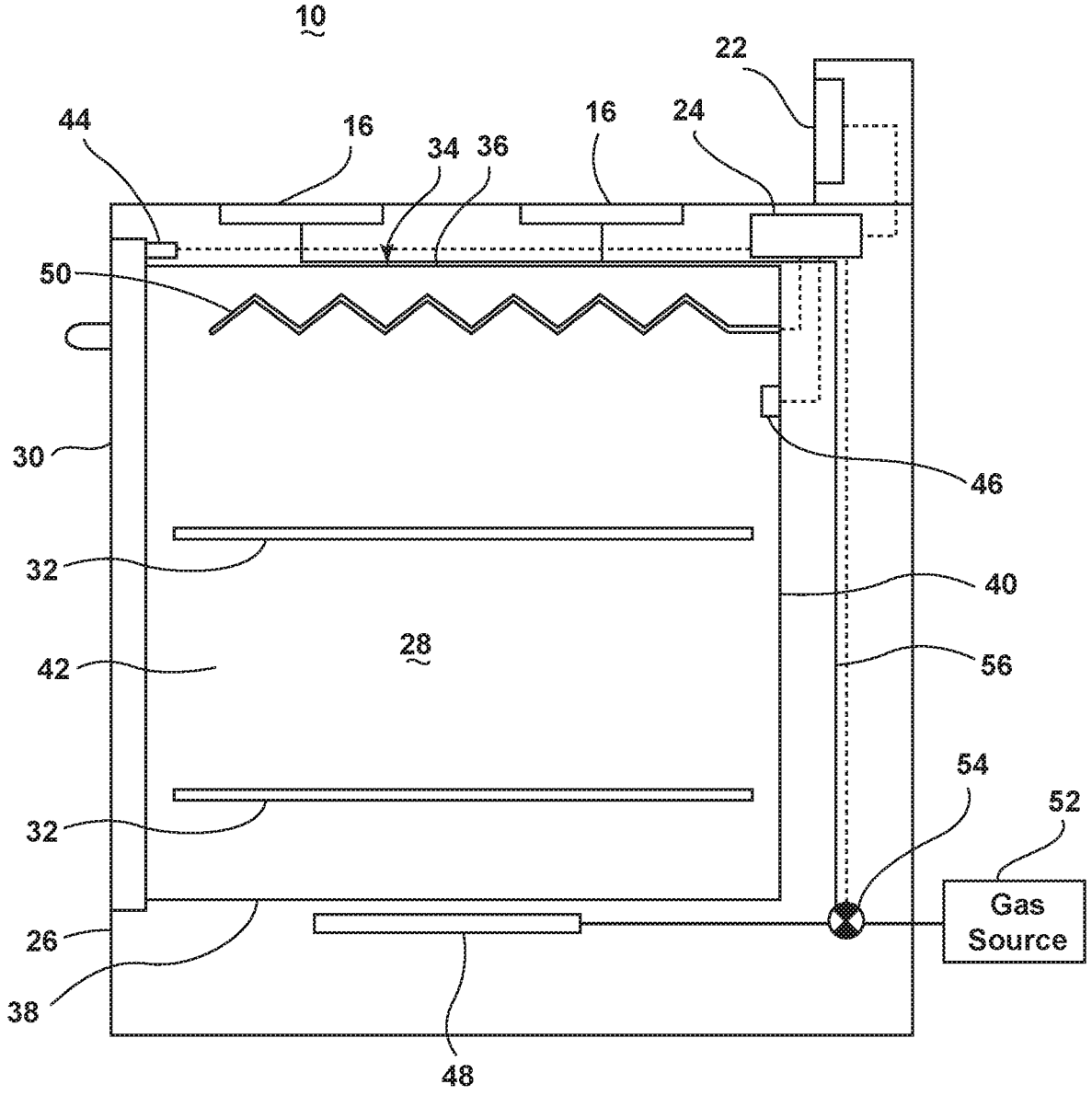
FIG. 2 is a cross-sectional, schematic side view of the cooking appliance of FIG. 1.

Referring to FIG. 2, the cooking appliance 10, and specifically the oven 12 portion, can include a cabinet 26 with an open-faced cooking cavity 28 and a door 30 that can be selectively opened and closed to provide access to the cooking cavity 28. One or more racks 32 can be selectively positioned within the cooking cavity 28 for supporting food items within the cooking cavity 28. The cooking cavity 28 can be defined by a housing 34 having an upper wall 36, a bottom wall 38, a rear wall 40 and a pair of opposing side walls 42. A door sensor 44 can be provided for detecting an opened and closed position of the door 30. The cooking cavity can also be provided with a temperature sensor 46 for determining an air temperature within the cooking cavity 28.

The cooking appliance 10 also includes a heating system for heating the cooking cavity 28 according to a cycle of operation, which can comprise a gas heating element 48 and an electric heating element 50. While the gas heating element 48 is illustrated as a linear strip and the electric heating element 50 is illustrated as a zig-zag line, these shapes are selected to visually differentiate the two types of heating elements 48, 50 and need not represent the actual shape of the heating elements 48, 50.

The gas heating element 48 can be in the form of one or more conventional gas burner(s) connected to a source of gas 52 provided beneath the bottom wall 38 of the cooking cavity 28 such that heat from the gas heating element 48 conducts through the bottom wall 38 into the cooking cavity 28. Heat may also be conducted to the cooking cavity 28 through one or more vents in the cooking cavity 28 (not shown).

A gas valve 54 can be provided between the lower gas heating element 48 and the gas source 52, and also between the gas source 52 and at least one hob 16, to regulate the supply of gas from the gas source 52 to the gas heating element 48 and/or the hob 16. A gas delivery conduit 56 can fluidly couple the gas source 52 and the gas valve 54 with the at least one hob 16. The gas valve 54 can selectively supply gas from the gas source 52 to one of the gas heating element 48 or the hob 16, or to both the gas heating element 48 or the hob 16 at the same time. The gas valve 54 can be moveable between a closed position where gas does not flow through the gas valve 54 and a fully opened position in which gas flows through the gas valve 54 at a maximum rate. Alternatively, the gas valve 54 can be a proportional valve, such that the gas can be controlled to flow through the gas valve 54 at flow rates other than the maximum rate. An exemplary proportional valve is disclosed in U.S. Patent Application Publication No. 20070278319, filed May 15, 2006, now abandoned, which is incorporated herein by reference in its entirety.

The electric heating element 50 can be provided in an upper portion of the cooking cavity 28, spaced below the upper wall 36 of the cooking cavity 28, such that the electric heating element 50 projects into the cooking cavity 28. The electric heating element 50 can be mounted to the rear wall 40 of the cooking cavity 28, suspended from the upper wall 36 of the cooking cavity 28, and/or mounted to the side walls 42 of the cooking cavity 28. The mounting of the electric heating element 50 is not germane to the aspects of the present disclosure. The electric heating element 50 can be in the form of a resistive heating element that converts electrical energy into heat, as is known in the art.

Figure 3:
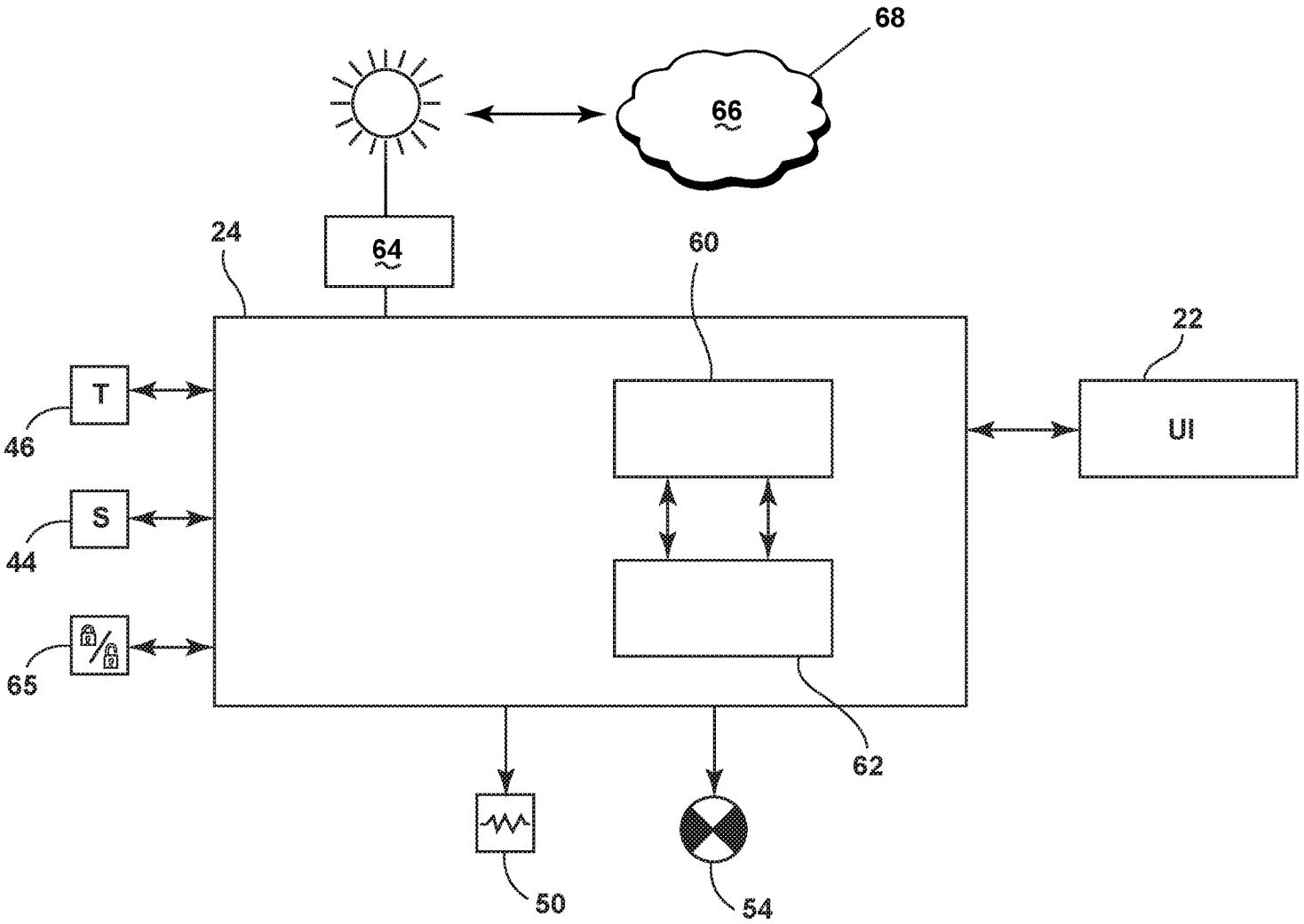
FIG. 3 is a schematic representation of a controller for controlling the operation of one or more components of the cooking appliance of FIG. 1.

Referring now to FIG. 3, the controller 24 can be provided with a memory 60 and a central processing unit (CPU) 62, as well as any other suitable component, for controlling and operating the cooking appliance 10. The memory 60 can be used for storing the control software that is executed by the CPU 62 in completing a cycle of operation using the cooking appliance 10 as well as any additional software.

The memory 60 can also be used to store information, such as a database or table, and to store data received from the one or more components of the cooking appliance 10 that can be communicably coupled with the controller 24. The database or table can be used to store the various operating parameters for the cooking appliance 10, including factory default values for operating parameters and any adjustments to the factory default values by the control system or by user input. Additionally, it is contemplated that the memory 60 can store common settings, recipes, or other preferences common to the user, or any information.

The controller 24 can be communicably and operably coupled with one or more components of the cooking appliance 10 for communicating with and controlling the operation of the component to complete a cycle of operation. For example, the controller 24 can be coupled with the gas valve 54 for controlling the heat output provided by the gas heating element 48 to the cooking cavity 28, as well as for controlling the heat output provided by the hobs 16. The controller 24 can also be coupled with the electric heating element 50 for controlling the heat output provided to the cooking cavity 28 from the electric heating element 50. The controller 24 can also be coupled with the user interface 22 for receiving user selected inputs and communicating information to the user. For example, the user may select a temperature set point which the user desires the temperature of the cooking cavity 28 to reach, or a cycle of operation which includes one or more temperature set points the temperature of the cooking cavity 28 reaches during the course of the cycle of operation. Non-limiting examples of a cycle of operation include a pre-heating cycle, a cooking cycle, a baking cycle, a bread-proofing cycle, a defrost cycle, a warming cycle, a self-cleaning cycle, and a broiling cycle.

The controller 24 can also be coupled with a door lock 65 for selectively locking and unlocking the door 30 to limit access to the cooking cavity 28.

The controller 24 can also receive input from various sensors, such as the door sensor 44 for determining when the door 30 is in the opened or closed position, and the temperature sensor 46 for determining an air temperature within the cooking cavity 28. While the temperature sensor 46 is illustrated as a single temperature sensor 46, it will be understood that more than one temperature sensor 46 can be provided in one or more locations within and/or adjacent to the cooking cavity 28 or the hob 16 to determine the temperature within the cooking cavity 28 or at the hob 16.

The cooking appliance 10 can be coupled to the wireless communication module 64, such as a combination transmitter and receiver. The wireless communication module 64 can be used for communication with the network 66, for example, such as a database or the internet via WI-FI. Another exemplary network 66 can include what is commonly referred to as the 'Cloud' 68, as a remote storage location for providing information, storage, data, or computational assistance (commonly referred to as cloud-computing or cloud-processing) utilizing a cloud-based processor in communication with the cooking appliance 10 via the network connection. Alternatively or additionally, the wireless communication module 64 could be used for local communication, such as with the user, a user's smartphone, or other local device such as a laptop, or other local appliances. In this way, the wireless communication module 64 further provides for open loop communication with the user remote from the cooking appliance 10.

Furthermore, the wireless communication module 64 can provide for remote monitoring of the cooking process, such as by communicating with a user remote from the cooking appliance 10. Such communication can include status, time remaining, or alerts, in non-limiting examples.

Figure 4:
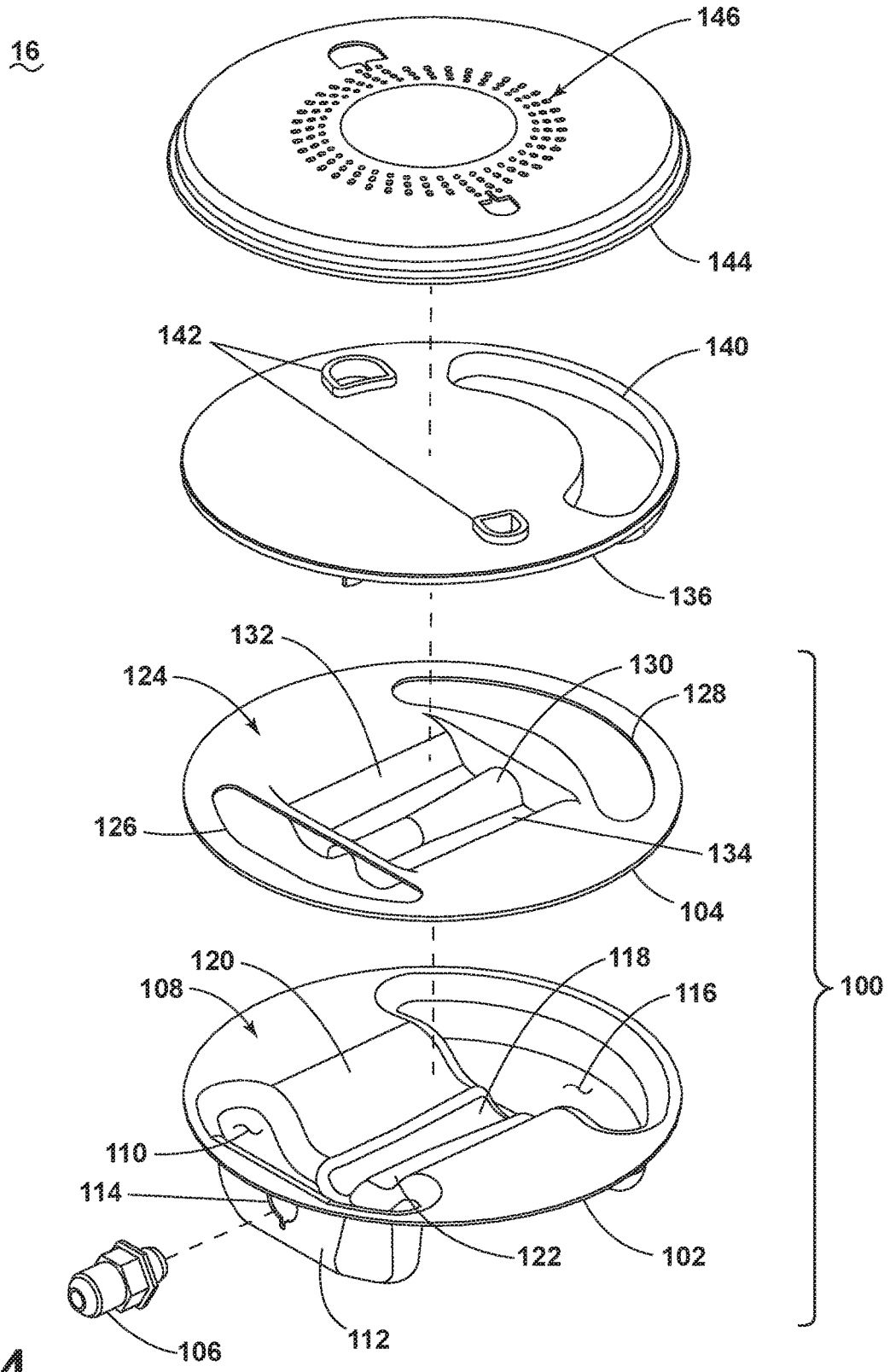
FIG. 4 is an exploded view of an example of one of the cooking hobs of FIG. 1.

Referring now to FIG. 4, the hob 16 comprises an injector holder base 102, an injector holder cover 104, and an injector 106 that can be collectively thought of as an injector holder assembly 100 portion of the hob 16. The injector holder base 102 includes a top surface 108. The injector holder base 102 can define an air chamber 110 and a burner interface chamber 116, both of which extend downwardly from the top surface 108. The air chamber 110 can extend downwardly from the top surface 108 to define at least a sidewall 112. An injector receiving opening 114 can be defined by and provided within the sidewall 112 and is shaped and sized to receive the injector 106 such that the injector 106 is carried by the injector holder base 102, and specifically by the air chamber 110. The injector 106 can alternately or additionally be carried by the injector holder cover 104 such that the injector 106 is adjacent to the air chamber 110. The injector 106 can be configured to supply gas to the air chamber 110 from the gas source 52 and selectively via the gas valve 54.

A first open channel 118 can also be defined by the injector holder base 102 and extend downwardly from the top surface 108. The first open channel 118 fluidly couples the air chamber 110 and the burner interface chamber 116. At least one depression, illustrated herein as a first depression 120 and a second depression 122, can extend alongside at least a portion of the length of the first open channel 118. The first and second depressions 120, 122 of the injector holder base 102 can also extend downwardly from the top surface 108, but may not extend as far downward from the top surface 108 as the first open channel 118. The first and second depressions 120, 122 can be provided along opposite sides of the first open channel 118 from one another. By way of non-limiting example, the first and second depressions 120, 122 can be parallel or substantially parallel to one another. The injector 106 can be fluidly coupled to the air chamber 110 at the sidewall 112 that is provided opposite the first open channel 118 across the air chamber 110.

The injector holder cover 104 can be sized and have a periphery and profile shaped similarly to the injector holder base 102 such that the injector holder cover 104 can overlie and be coupled to the injector holder base 102. The injector holder cover 104 includes a top surface 124 that defines a first opening 126 and a second opening 128. The first opening 126 can at least partially overlie the air chamber 110 while the second opening 128 can at least partially overlie the burner interface chamber 116 when the injector holder cover 104 is coupled to the injector holder base 102.

The injector holder cover 104 further defines a second open channel 130 that confronts the first open channel 118 when the injector holder cover 104 overlies the injector holder base 102. When the injector holder cover 104 overlies the injector holder base 102, the first open channel 118 and the second open channel 130 can collectively define a venturi tube 150 (FIG. 5) that extends between and fluidly couples the air chamber 110 and the burner interface chamber 116.

The injector holder cover 104 further defines at least one depression, illustrated herein as a first depression 132 and a second depression 134, that extends alongside at least a portion of the length of the second open channel 130. The first and second depressions 132, 134 can be provided along opposite sides of the second open channel 130 from one another. By way of non-limiting example, the first and second depressions 132, 134 can be parallel or substantially parallel to one another. The first and second depressions 132, 134 of the injector holder cover 104 can extend downwardly from the top surface 124 having a profile, an angle, and a depth the same as and complementary to the first and second depressions 120, 122 of the injector holder base 102 such that the first and second depressions 132, 134 of the injector holder cover 104 can be received within the first and second depressions 120, 122 of the injector holder base 102 when the injector holder cover 104 overlies the injector holder base 102.

The second open channel 130 can extend upwardly from a lowermost extent of the first and second depressions 132, 134 such that the second open channel 130 defines a profile extending opposite of and away from the profile of the first open channel 118 when the injector holder cover 104 overlies the injector holder base 102.

A burner support 136 can overlie the injector holder cover 104. The burner support 136 can define at least a support opening 140. The support opening 140 can at least partially overlie the second opening 128 of the injector holder cover 104. The burner support 136 can also include alignment portions 142 which can be raised from and protrude upwardly from the burner support 136. By way of non-limiting example, the burner support 136 can be formed of aluminum alloy, which can be formed by die casting.

A burner 144 can overlie the burner support 136 such that the alignment portions 142 can support the burner 144 and ensure that the burner support 136 and the burner 144 are properly and securely aligned with one another. The burner 144 can define a plurality of burner openings 146 through which heat for cooking, which can be provided by flames fueled by gas from the injector 106, can pass.

Figure 5:
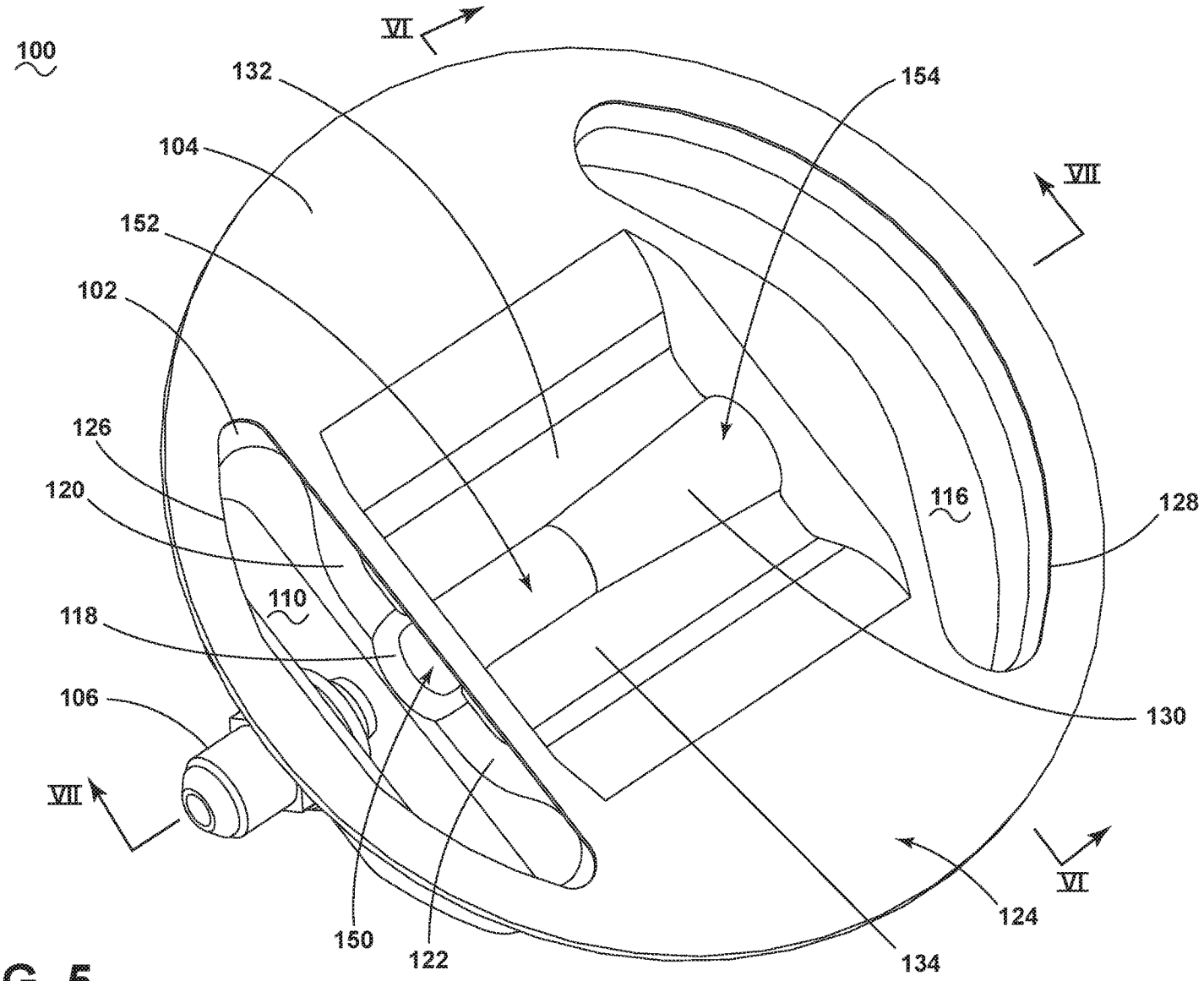
FIG. 5 is a perspective view of an injector holder assembly portion of the hob of FIG. 4.

FIG. 5 illustrates the injector holder assembly 100 portion of the hob 16 in an assembled condition wherein the injector holder cover 104 overlies and is coupled to the injector holder base 102. The first open channel 118 and the second open channel 130 collectively form the venturi tube 150. The venturi tube 150 can comprise at least a first portion 152 and a second portion 154, the second portion 154 having a maximum width or diameter that is greater than a maximum width or diameter of the first portion 152. While the first portion 152 is illustrated herein as having a uniform width or diameter while the second portion 154 has a width or diameter that increases along its length, it will be understood that either or both of the first portion 152 and the second portion 154 can have a uniform width or diameter or a diameter that increases or decreases along its length, so long as the maximum width or diameter of the second portion 154 remains greater than a maximum width or diameter of the first portion 152.

Figure 6:
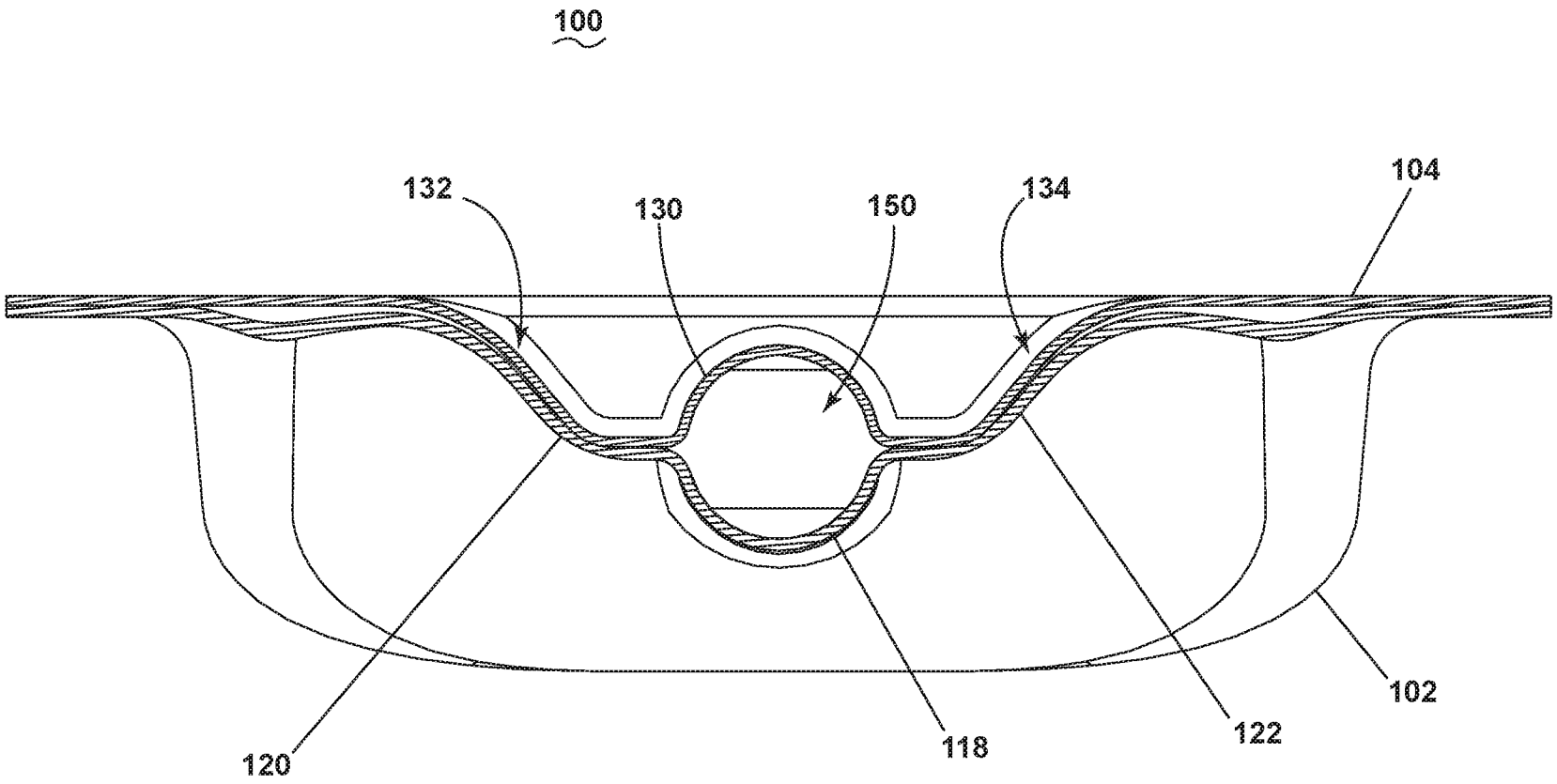
FIG. 6 is a cross-sectional view of the injector holder assembly portion of FIG. 5 taken along line VI-VI.

FIG. 6 illustrates a cross-sectional view of the injector holder assembly 100 portion of the hob 16 along line VI-VI of FIG. 5. When the injector holder cover 104 overlies the injector holder base 102, and the first open channel 118 and the second open channel 130 collectively form the venturi tube 150, the first and second depressions 132, 134 of the injector holder cover 104 are received within the first and second depressions 120, 122 of the injector holder base 102. In one aspect, both the injector holder base 102 and the injector holder cover 104 can be molded from a sheet of metal, which can be, by way of non-limiting example, a sheet of iron. The molded metal injector holder cover 104 and injector holder base 102 can be stamped together. In one example, the injector holder cover 104 and the injector holder base 102 can be stamped together such that the first and second depressions 132, 134 of the injector holder cover 104 are not only received within, but also frictionally retained within the first and second depressions 120, 122 of the injector holder base 102, such as by an interference fit. Further, the stamping of the injector holder base 102 with the injector holder cover 104 can cause the first and second depressions 132, 134 of the injector holder cover 104 and the first and second depressions 120, 122 of the injector holder base 102 to be deflected with one another or co-deflected, resulting in a more durable and resilient fit between the injector holder cover 104 and the injector holder base 102.

Figure 7:
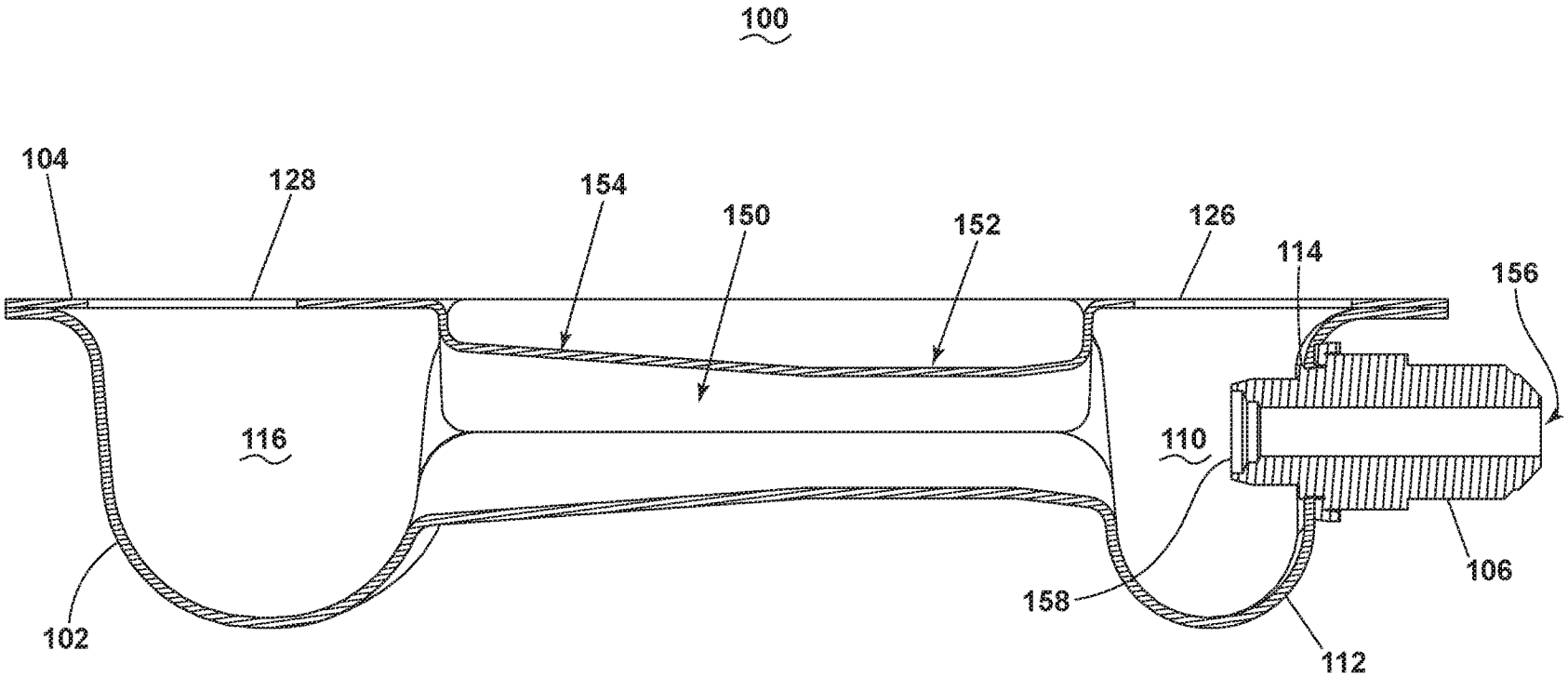
FIG. 7 is a cross-sectional view of the injector holder assembly portion of FIG. 5 taken along line VII-VII.

Turning now to the operation of the injector holder assembly 100 portion of the hob 16, FIG. 7 illustrates a cross-sectional view taken along line VII-VII of FIG. 5. The injector 106 is received within the injector receiving opening 114 in the sidewall 112 of the air chamber 110. The injector 106 comprises an injector inlet 156 that can be selectively fluidly coupled to the gas source 52 by the gas valve 54, and further by the gas delivery conduit 56 extending between the gas valve 54 and the injector inlet 156. Gas entering the injector 106 through the injector inlet 156 can exit the injector 106 through an injector outlet 158 to flow into the air chamber 110. In the air chamber 110, gas from the injector 106 can mix with ambient air, which can be drawn into the air chamber 110 through the first opening 126 of the injector holder cover 104, for example by being drawn between the top surface 124 of the injector holder cover 104 and the burner support 136 to flow through the first opening 126.

Gas can further flow from the injector 106 through the air chamber 110 and into the venturi tube 150. Gas flowing into the venturi tube 150 creates a venturi effect that also serves to draw additional air into the venturi tube 150 along with the gas to further form a gas-air mixture. The gas-air mixture flows from the venturi tube 150 into the burner interface chamber 116 to interface with the burner 144 by flowing from the burner interface chamber 116 through the second opening 128 of the injector holder cover 104, the support opening 140, to the burner 144 and through the burner openings 146.

Figure 8:
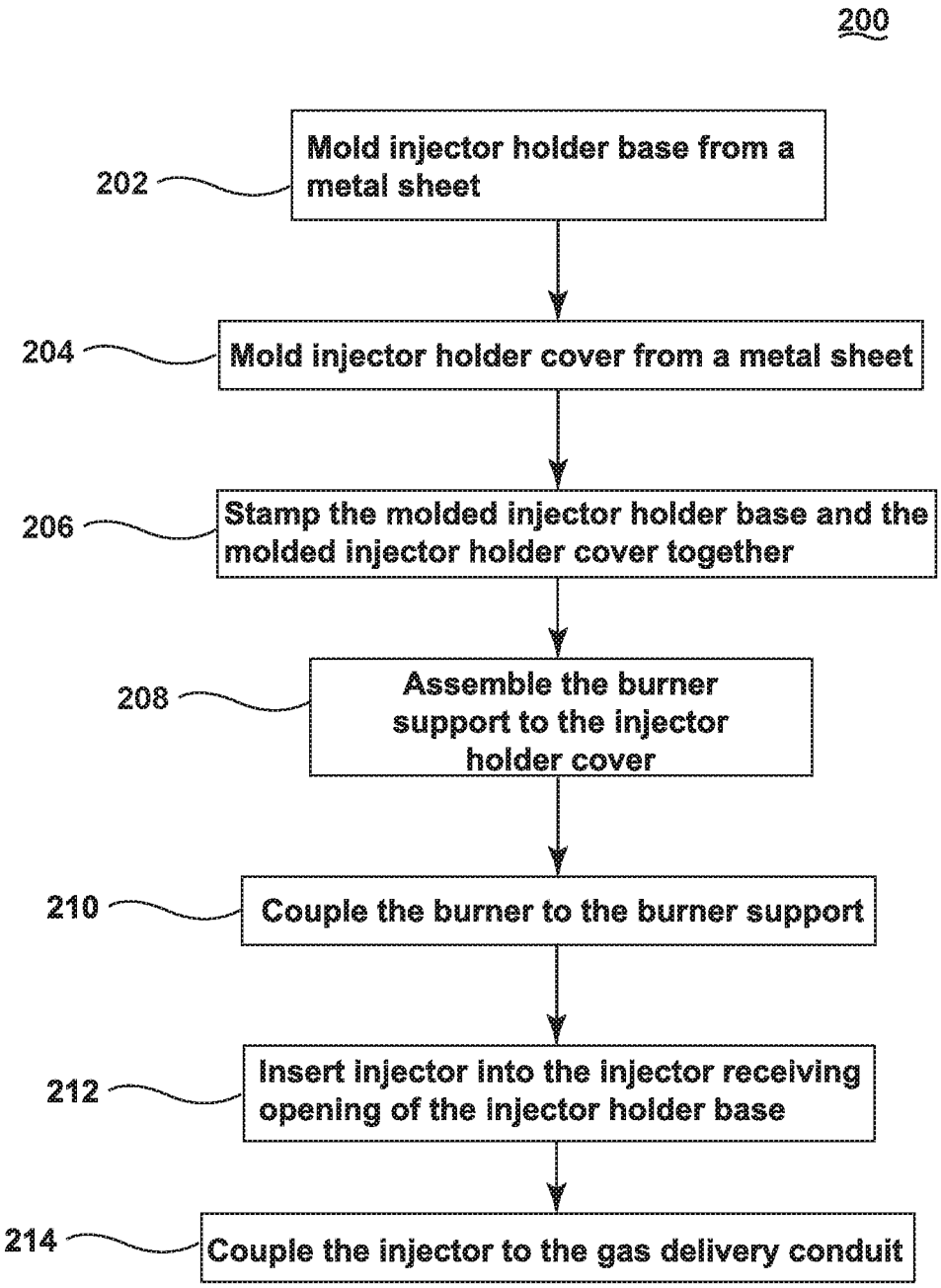
FIG. 8 is a flow chart illustrating an exemplary method for assembling the hob of FIG. 4.

FIG. 8 illustrates a flow chart of a method 200 for assembling the injector holder assembly 100 portion of the hob 16. The sequence of steps depicted for this method and the proceeding methods are for illustrative purposes only, and is not meant to limit any of the methods in any way as it is understood that the steps may proceed in a different logical order or additional or intervening steps may be included without detracting from the present disclosure.

At 202, the injector holder base 102 can be molded from a metal sheet, which can be a sheet of iron. At 204, the injector holder cover 104 can be molded from a metal sheet, which can be a sheet of iron. Steps 202 and 204 can be performed concurrently, or one after the other in any suitable order. At 206, the molded injector holder base 102 and injector holder cover 104 are stamped together such that the injector holder cover 104 is resiliently retained by the injector holder base 102. At 208, the burner support 136 is assembled to the injector holder cover 104. At 210, the burner 144 is coupled to the burner support 136. At 212, the injector 106 is inserted into the injector receiving opening 114 of the injector holder base 102. At 214, the injector 106, and specifically the injector inlet 156, is coupled to the gas delivery conduit 56.

Figure 9:
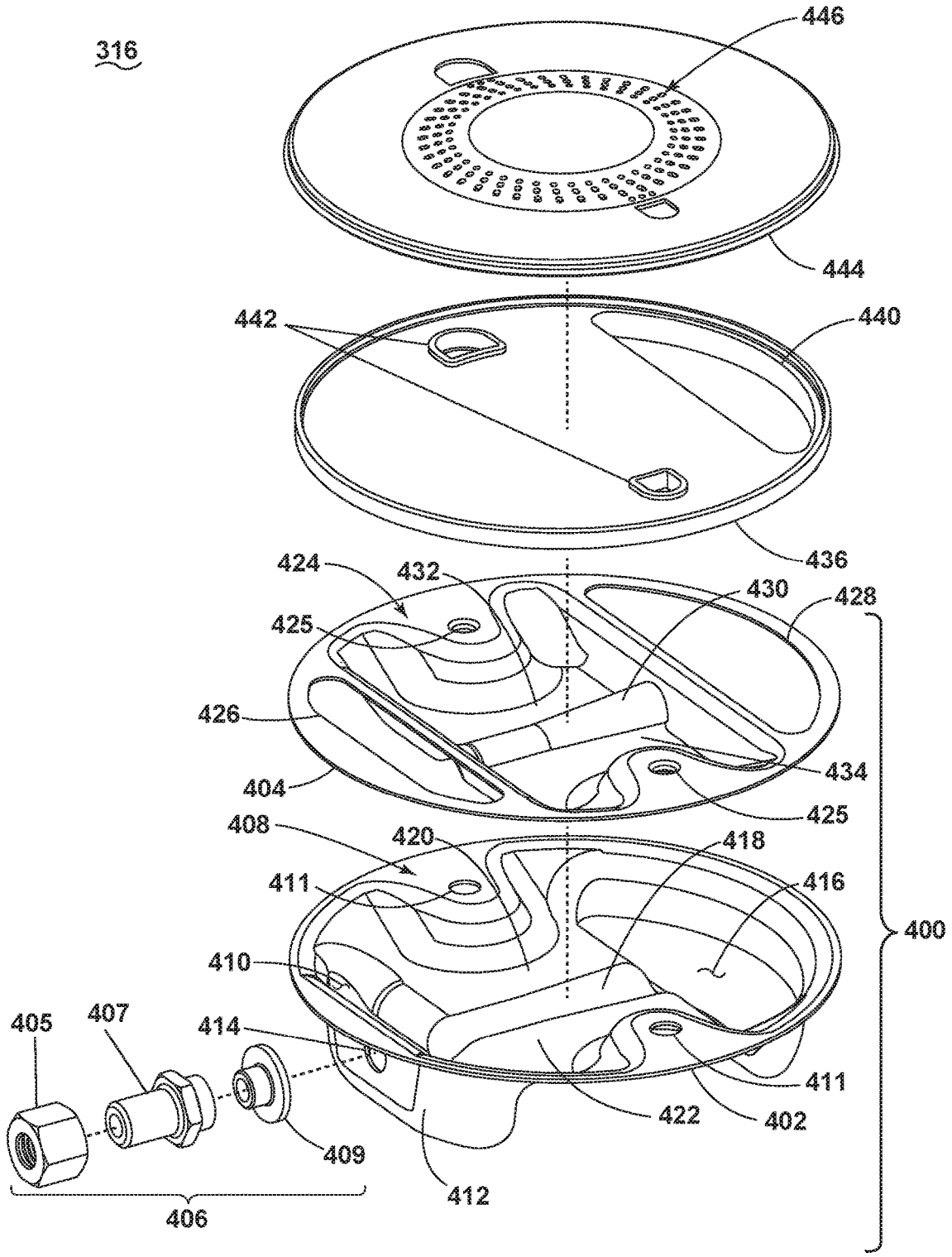
FIG. 9 is an exploded view of another example of one of the cooking hobs of FIG. 1.

Referring now to FIG. 9, another example of a hob 316 including an injector holder assembly 400 portion that can be provided within the stovetop 14 of the cooking appliance 10 is illustrated. The hob 316 and the injector holder assembly 400 portion are similar to the first hob 16 and the first injector holder assembly 100 portion; therefore, like parts will be identified with numerals increased by 300, with it being understood that the description of the like parts of the first hob 16 applies to the second hob 316 and like parts of the first injector holder assembly 100 apply to the second injector holder assembly 400, unless otherwise noted. The hob 316 and injector holder assembly 400 can be assembled and can function in a manner substantially identical to the hob 16 and injector holder assembly 100. In one example, the only differences between the hob 16 and the injector holder assembly 100 and the hob 316 and the injector holder assembly 400 can be that the chambers, openings, and depressions can be shaped differently, that additional fastening means for the hob 316 can be provided, and that the structure of the injector can differ.

The hob 316 comprises an injector holder base 402, an injector holder cover 404, and an injector assembly 406 that can be collectively thought of as the injector holder assembly 400 portion of the hob 316. The injector assembly 406 can comprise an injector body 407, which can be similar to the injector 106, and can further comprise an injector outlet coupler 409 and an injector fastener 405. The injector outlet coupler 409 can couple the injector body 407 with the injector holder base 402, while the injector fastener 405 can at least partially receive the injector body 407 and can further couple, such as by threadable coupling, with the gas delivery conduit 56.

The injector holder base 402 includes a top surface 408. The top surface 408 can define at least one assembly opening 411. The injector holder base 402 can define an air chamber 410 and a burner interface chamber 416, both of which extend downwardly from the top surface 408. The air chamber 410 can extend downwardly from the top surface 408 to define at least a sidewall 412. An injector receiving opening 414 can be defined by and provided within the sidewall 412 and is shaped and sized to receive at least a portion of the injector assembly 406, and in particular the injector outlet coupler 409, such that the injector body 407 is carried by the injector holder base 402, and specifically by the air chamber 410. The injector assembly 406 can alternately or additionally be carried by the injector holder cover 404 such that the injector assembly 406 is adjacent to the air chamber 410. The injector assembly 406 can be configured to supply gas to the air chamber 410 from the gas source 52 and selectively via the gas valve 54.

A first open channel 418 can also be defined by the injector holder base 402 and extend downwardly from the top surface 408. The first open channel 418 fluidly couples the air chamber 410 and the burner interface chamber 416. At least one depression, illustrated herein as a first depression 420 and a second depression 422, can extend alongside at least a portion of the length of the first open channel 418. The first and second depressions 420, 422 of the injector holder base 402 can also extend downwardly from the top surface 408, but may not extend as far downward from the top surface 408 as the first open channel 418. The first and second depressions 420, 422 can be provided along opposite sides of the first open channel 418 from one another. By way of non-limiting example, the first and second depressions 420, 422 can be symmetrical or substantially symmetrical to one another and can include at least portions that are parallel or substantially parallel to one another. The injector assembly 406 can be fluidly coupled to the air chamber 410 at the sidewall 412 that is provided opposite the first open channel 418 across the air chamber 410.

The injector holder cover 404 can be sized and have a periphery and profile shaped similarly to the injector holder base 402 such that the injector holder cover 404 can overlie and be coupled to the injector holder base 402. The injector holder cover 404 includes a top surface 424 that defines a first opening 426 and a second opening 428. The first opening 426 can at least partially overlie the air chamber 410 while the second opening 428 can at least partially overlie the burner interface chamber 416 when the injector holder cover 404 is coupled to the injector holder base 402. The top surface 424 can further define at least one assembly coupling 425. In one non-limiting example, the at least one assembly coupling 425 is positioned to couple with the at least one assembly opening 411 when the injector holder cover 404 is coupled to the injector holder base 402. By way of further example, the at least one assembly coupling 425 can be received by or nested within the at least one assembly opening 411.

The injector holder cover 404 further defines a second open channel 430 that confronts the first open channel 418 when the injector holder cover 404 overlies the injector holder base 402. When the injector holder cover 404 overlies the injector holder base 402, the first open channel 418 and the second open channel 430 can collectively define a venturi tube 450 (FIG. 10) that extends between and fluidly couples the air chamber 410 and the burner interface chamber 416.

The injector holder cover 404 further defines at least one depression, illustrated herein as a first depression 432 and a second depression 434, that extends alongside at least a portion of the length of the second open channel 430. The first and second depressions 432, 434 can be provided along opposite sides of the second open channel 430 from one another. By way of non-limiting example, the first and second depressions 432, 434 can be symmetrical or substantially symmetrical to one another and can include at least portions that are parallel or substantially parallel to one another. The first and second depressions 432, 434 of the injector holder cover 404 can extend downwardly from the top surface 424 having a profile, an angle, and a depth the same as and complementary to the first and second depressions 420, 422 of the injector holder base 402 such that the first and second depressions 432, 434 of the injector holder cover 404 can be received within the first and second depressions 420, 422 of the injector holder base 402 when the injector holder cover 404 overlies the injector holder base 402.

The second open channel 430 can extend upwardly from a lowermost extent of the first and second depressions 432, 434 such that the second open channel 430 defines a profile extending opposite of and away from the profile of the first open channel 418 when the injector holder cover 404 overlies the injector holder base 402.

A burner support 436 can overlie the injector holder cover 404. The burner support 436 can define at least a support opening 440. The support opening 440 can at least partially overlie the second opening 428 of the injector holder cover 404. The burner support 436 can also include alignment portions 442 which can be raised from and protrude upwardly from the burner support 436. By way of non-limiting example, the burner support 436 can be formed of aluminum alloy, which can be formed by die casting.

A burner 444 can overlie the burner support 436 such that the alignment portions 442 can support the burner 444 and ensure that the burner support 436 and the burner 444 are properly and securely aligned with one another. The burner 444 can define a plurality of burner openings 446 through which heat for cooking, which can be provided by flames fueled by gas from the injector assembly 406, can pass.

Figure 10:
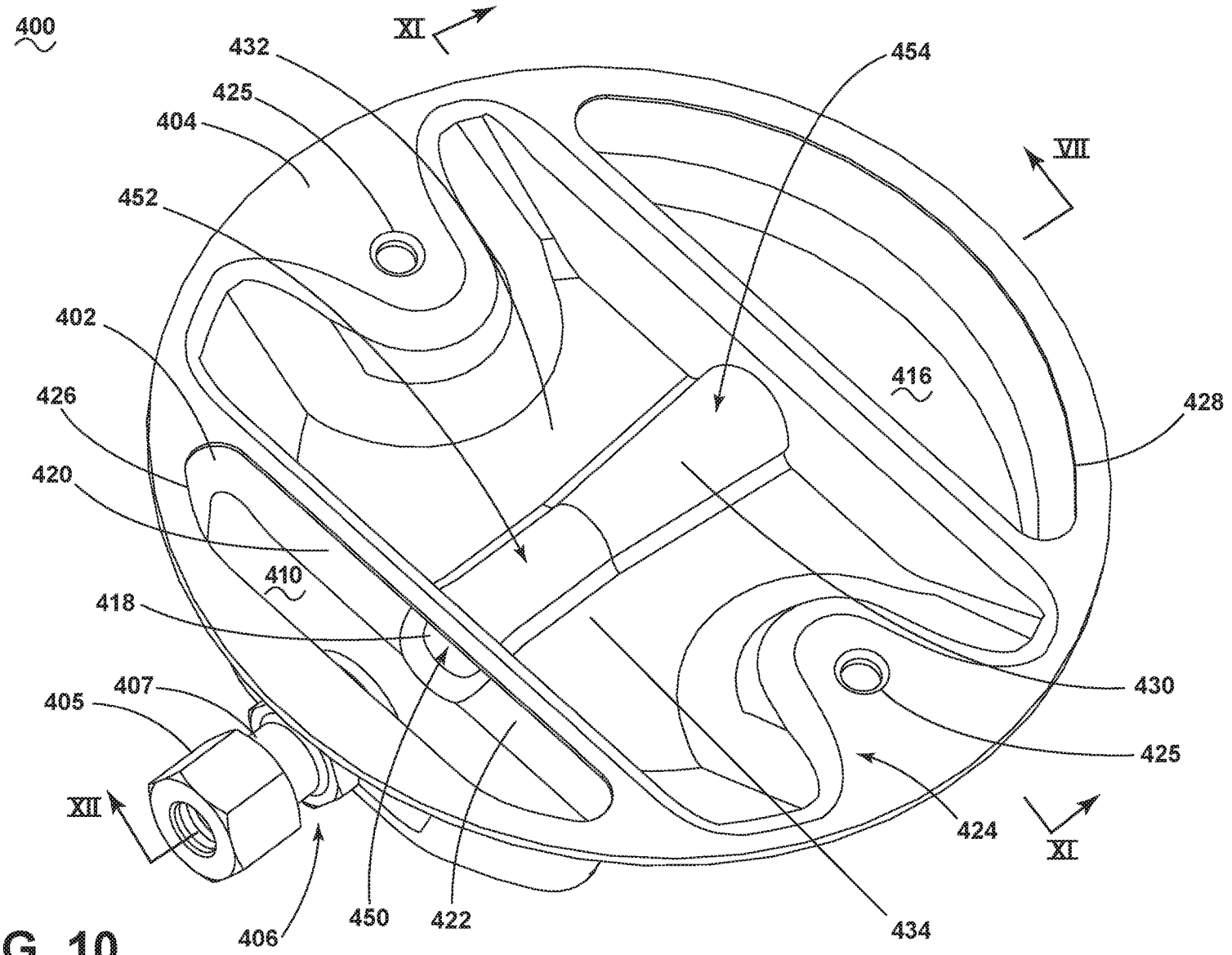
FIG. 10 is a perspective view of an injector holder assembly portion of the hob of FIG. 9.

FIG. 10 illustrates the injector holder assembly 400 portion of the hob 316 in an assembled condition wherein the injector holder cover 404 overlies and is coupled to the injector holder base 402. The first open channel 418 and the second open channel 430 collectively form the venturi tube 450. The venturi tube 450 can comprise at least a first portion 452 and a second portion 454, the second portion 454 having a maximum width or diameter that is greater than a maximum width or diameter of the first portion 452. While the first portion 452 is illustrated herein as having a uniform width or diameter while the second portion 454 has a width or diameter that increases along its length, it will be understood that either or both of the first portion 452 and the second portion 454 can have a uniform width or diameter or a diameter that increases or decreases along its length, so long as the maximum width or diameter of the second portion 454 remains greater than a maximum width or diameter of the first portion 452.

Figure 11:
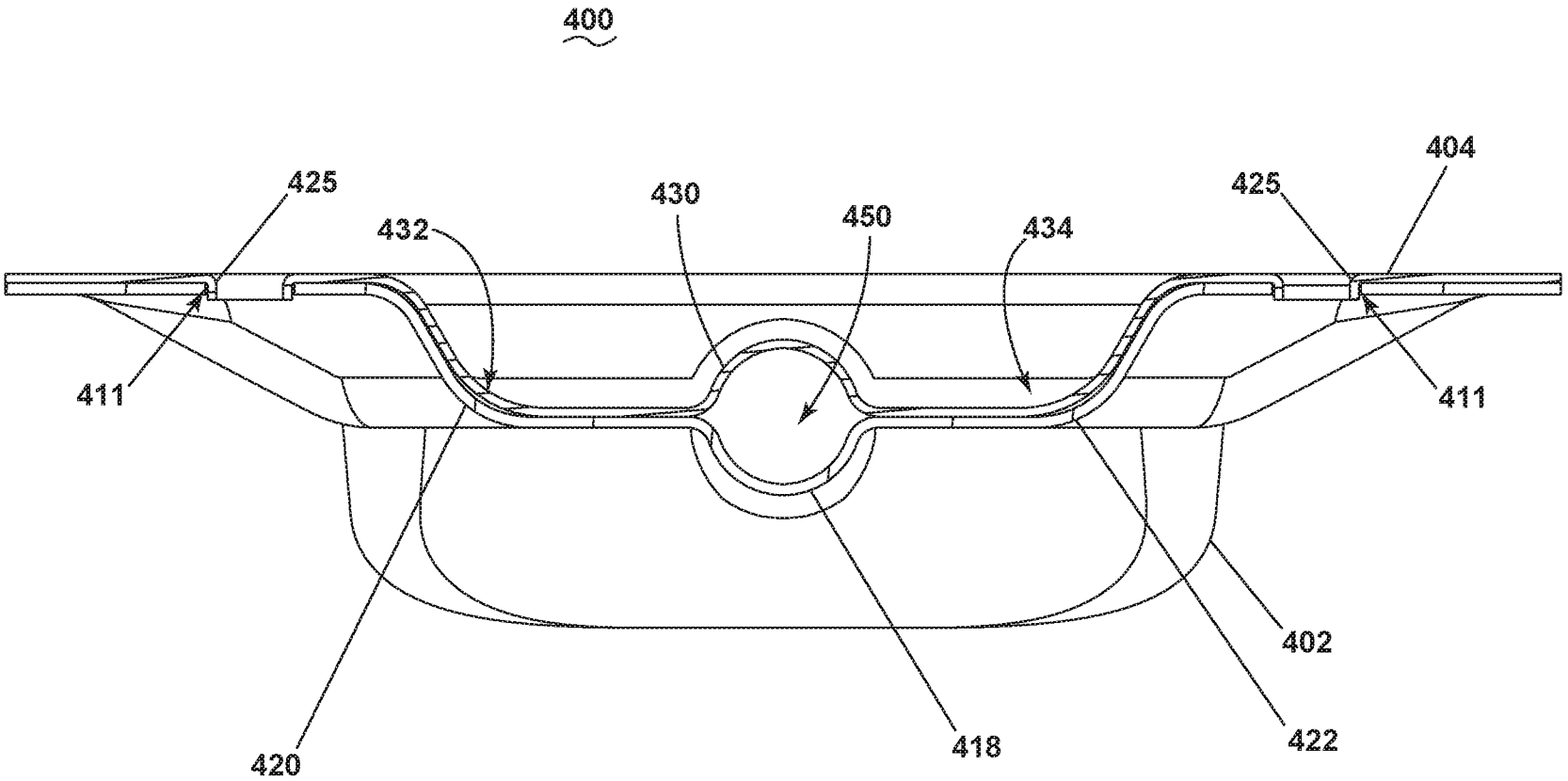
FIG. 11 is a cross-sectional view of the injector holder assembly portion of FIG. 10 taken along line XI-XI.

FIG. 11 illustrates a cross-sectional view of the injector holder assembly 400 portion of the hob 316 along line XI-XI of FIG. 10. When the injector holder cover 404 overlies the injector holder base 402, the at least one assembly coupling 425 is received by the at least one assembly opening 411, and the first open channel 418 and the second open channel 430 collectively form the venturi tube 450, the first and second depressions 432, 434 of the injector holder cover 404 are received within the first and second depressions 420, 422 of the injector holder base 402. In one aspect, both the injector holder base 402 and the injector holder cover 404 can be molded from a sheet of metal, which can be, by way of non-limiting example, a sheet of iron. The molded metal injector holder cover 404 and injector holder base 402 can be stamped together. In one example, the injector holder cover 404 and the injector holder base 402 can be stamped together such that the first and second depressions 432, 434 of the injector holder cover 404 are not only received within, but also frictionally retained within the first and second depressions 420, 422 of the injector holder base 402, such as by an interference fit. Further, the stamping of the injector holder base 402 with the injector holder cover 404 can cause the first and second depressions 432, 434 of the injector holder cover 404 and the first and second depressions 420, 422 of the injector holder base 402 to be deflected with one another or co-deflected, resulting in a more durable and resilient fit between the injector holder cover 404 and the injector holder base 402.

Figure 12:
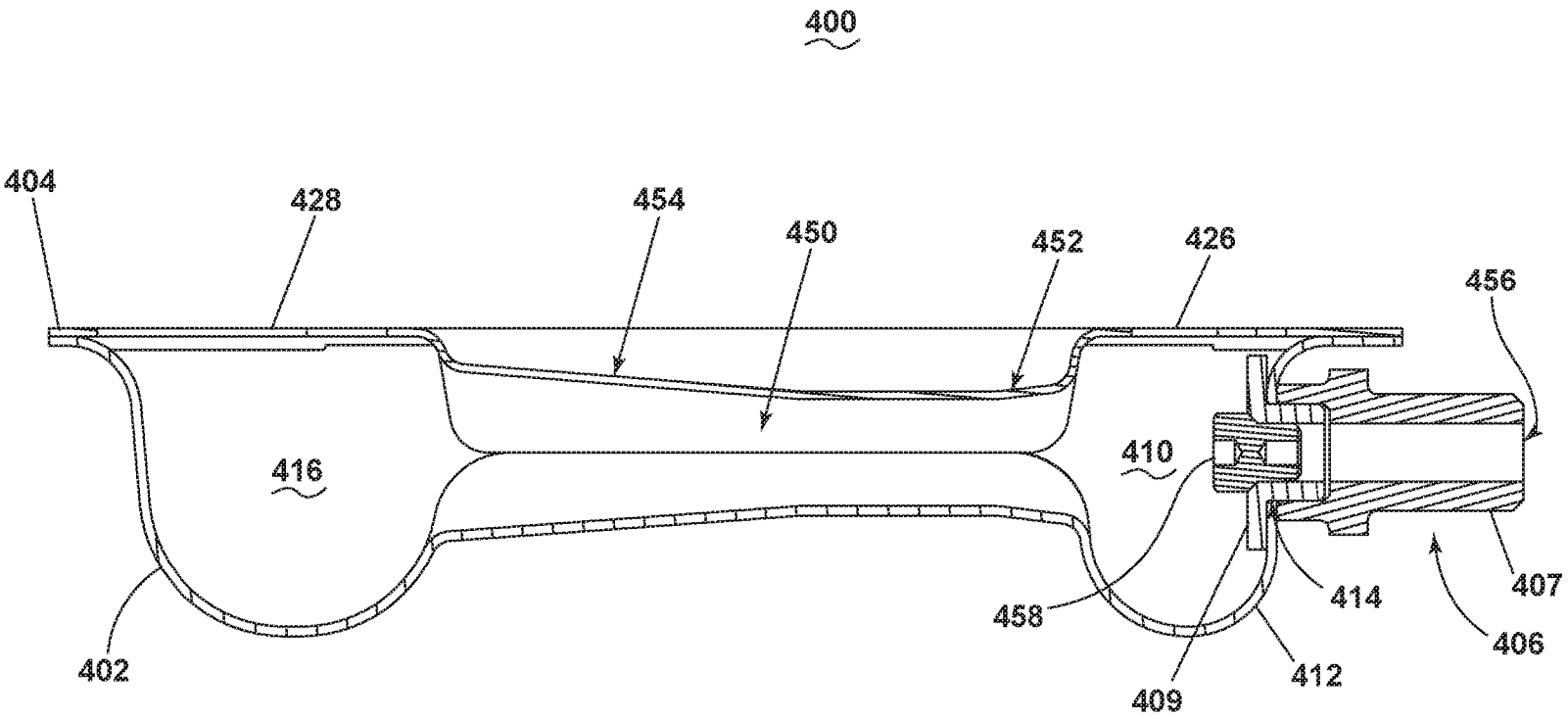
FIG. 12 is a cross-sectional view of the injector holder assembly portion of FIG. 10 taken along line XII-XII.

Turning now to the operation of the injector holder assembly 400 portion of the hob 316, FIG. 12 illustrates a cross-sectional view taken along line XII-XII of FIG. 10. The injector assembly 406 is coupled with the injector receiving opening 414. Specifically, the injector outlet coupler 409 is at least partially received within the injector receiving opening 414 in the sidewall 412 of the air chamber 410, the injector outlet coupler 409 further at least partially received by the injector body 407, such that the injector outlet coupler 409 couples the injector body 407 with the injector receiving opening 414. The injector body 407 comprises an injector inlet 456 that can be selectively fluidly coupled to the gas source 52 by the gas valve 54, and further by the gas delivery conduit 56 extending between the gas valve 54 and the injector inlet 456 and coupled to the injector inlet 456 by the injector fastener 405. Gas entering the injector body 407 through the injector inlet 456 can exit the injector assembly 406 through an injector outlet 458 defined by the injector outlet coupler 409 to then flow into the air chamber 410. In the air chamber 410, gas from the injector assembly 406 can mix with ambient air, which can be drawn into the air chamber 410 through the first opening 426 of the injector holder cover 404, for example by being drawn between the top surface 424 of the injector holder cover 404 and the burner support 436 to flow through the first opening 426.

Gas can further flow from the injector assembly 406 through the air chamber 410 and into the venturi tube 450. Gas flowing into the venturi tube 450 creates a venturi effect that also serves to draw additional air into the venturi tube 450 along with the gas to further form a gas-air mixture. The gas-air mixture flows from the venturi tube 450 into the burner interface chamber 416 to interface with the burner 444 by flowing from the burner interface chamber 416 through the second opening 428 of the injector holder cover 404, the support opening 440, to the burner 444 and through the burner openings 446.

It will be understood that the method 200 of FIG. 8 for assembling the injector holder assembly 100 portion of the hob 16 also applies for the assembly of the injector holder assembly 400 portion of the hob 316.

The aspects of the present disclosure described herein provide a hob for a cooking appliance that can delivery improved performance, ease, and cost of manufacturing compared to traditional hob assemblies. In traditional hobs, the injector holder base and cover may be formed by die casting using an aluminum alloy. By designing an injector holder assembly portion of the hob that can be formed by molding and stamping technology, cost savings in manufacturing can be realized. In order to accommodate the molding and stamping process, the shape and the features of the injector holder assembly portion can be specifically selected, such as by the inclusion of the depressions extending alongside the venturi tube that allow the injector holder base and the injector holder cover to be stamped together and resiliently retained with one another without the need for additional fastening mechanisms. The depressions can also provide a suitable mounting surface to which the burner support can be easily coupled for a correct interface.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A cooking appliance comprising:

a cooking area; and a hob located in the cooking area and comprising:

an injector holder base defining an air chamber, a burner interface chamber, and a first open channel fluidly coupling the air chamber and the burner interface chamber;

an injector holder cover overlying the injector holder base and stamped to the injector holder base, such that the injector holder cover and the injector holder base are fastened together by an interference fit or by co-deflection caused by stamping, without additional fastening mechanisms, the injector holder cover having a second open channel confronting the first open channel to collectively define a venturi tube extending between the air chamber and the burner interface chamber;

an injector carried by at least one of the injector holder base or injector holder cover and fluidly coupled to the air chamber opposite the venturi tube; and a burner supported on the injector holder cover and fluidly coupled to the burner interface chamber.

2. The cooking appliance of claim 1 wherein at least one of the injector holder base or the injector holder cover is formed by molding a sheet of metal prior to stamping the injector holder base and the injector holder cover to one another.

3. The cooking appliance of claim 2 wherein the sheet of metal comprises a sheet of iron.

4. The cooking appliance of claim 2 wherein both of the injector holder base and the injector holder cover are formed by molding a sheet of metal prior to stamping the injector holder base and the injector holder cover to one another.

5. The cooking appliance of claim 1 wherein the injector holder base further comprises at least one depression extending alongside at least a portion of the length of the first open channel.

6. The cooking appliance of claim 5 wherein the injector holder cover further comprises at least one depression extending alongside at least a portion of the length of the second open channel.

7. The cooking appliance of claim 6 wherein the at least one depression of the injector holder cover is received within the at least one depression of the injector holder base when the injector holder cover overlies the injector holder base.

8. The cooking appliance of claim 7 wherein the at least one depression of the injector holder cover is resiliently retained within the at least one depression of the injector holder base when the injector holder cover is stamped to the injector holder base.

9. The cooking appliance of claim 8 wherein the at least one depression of the injector holder cover is resiliently retained within the at least one depression of the injector holder base by an interference fit or by co-deflection of the depressions when the injector holder cover is stamped to the injector holder base.

10. The cooking appliance of claim 6 wherein the at least one depression extending alongside the at least a portion of the length of the first open channel comprises first and second depressions extending along opposite sides of the at least a portion of the length of the first open channel.

11. The cooking appliance of claim 10 wherein the at least one depression extending alongside the at least a portion of the length of the second open channel comprises first and second depressions extending along opposite sides of the at least a portion of the length of the second open channel.

12. The cooking appliance of claim 11 wherein the first and second depressions of the injector holder cover are received within the first and second depressions of the injector holder base when the injector holder cover overlies the injector holder base.

13. The cooking appliance of claim 12 wherein the first and second depressions of the injector holder cover are resiliently retained within the first and second depressions of the injector holder base when the injector holder cover is stamped to the injector holder base.

14. The cooking appliance of claim 13 wherein the first and second depressions of the injector holder cover are resiliently retained within the first and second depressions of the injector holder base by an interference fit or by co-deflection of the depressions when the injector holder cover is stamped to the injector holder base.

15. The cooking appliance of claim 14 wherein the first and second depressions of the injector holder cover are parallel to one another and the first and second depressions of the injector holder base are parallel to one another.

16. The cooking appliance of claim 1 wherein the injector holder cover and the injector holder base are fastened together only by the interference fit or by the co-deflection caused by stamping.

17. A cooking appliance comprising:

a cooking area; and a hob located in the cooking area and comprising:

an injector holder base defining an air chamber, a burner interface chamber, and a first open channel fluidly coupling the air chamber and the burner interface chamber;

an injector holder cover overlying the injector holder base and stamped to the injector holder base, such that the injector holder cover and the injector holder base are fastened together by co-deflection caused by stamping, without additional fastening mechanisms, the injector holder cover having a second open channel confronting the first open channel to collectively define a venturi tube extending between the air chamber and the burner interface chamber;

an injector carried by at least one of the injector holder base or injector holder cover and fluidly coupled to the air chamber opposite the venturi tube; and a burner supported on the injector holder cover and fluidly coupled to the burner interface chamber.

18. The cooking appliance of claim 17 wherein the injector holder cover and the injector holder base are fastened together only by the co-deflection caused by stamping.

19. A cooking appliance comprising:

a cooking area; and a hob located in the cooking area and comprising:

an injector holder base defining an air chamber, a burner interface chamber, and a first open channel fluidly coupling the air chamber and the burner interface chamber;

an injector holder cover overlying the injector holder base and stamped to the injector holder base, such that the injector holder cover and the injector holder base are fastened together by co-deflection caused by stamping, the injector holder cover having a second open channel confronting the first open channel to collectively define a venturi tube extending between the air chamber and the burner interface chamber;

an injector carried by at least one of the injector holder base or injector holder cover and fluidly coupled to the air chamber opposite the venturi tube; and a burner supported on the injector holder cover and fluidly coupled to the burner interface chamber.

20. The cooking appliance of claim 19 wherein the injector holder cover and the injector holder base are fastened together only by the co-deflection caused by stamping.

* * * * *